US005931751A

United States Patent [19]

Cooper

[11] Patent Number: 5,931,751

[45] Date of Patent: Aug. 3, 1999

[54] ARROWHEAD

[76] Inventor: Gary L. Cooper, 318 Blacksferry, Pocahontas, Ark. 72455

[21] Appl. No.: 08/851,726

[22] Filed: May 6, 1997

[51] Int. Cl.[6] ..... F42B 6/04; F42B 6/08

[52] U.S. Cl. ..... 473/583

[58] Field of Search ..... 473/578, 582, 473/583, 584, FOR 216, FOR 219, FOR 221, FOR 222

[56] References Cited

U.S. PATENT DOCUMENTS

| | | | |
|---|---|---|---|
| 3,653,664 | 4/1972 | Gentellalli . | |
| 3,756,600 | 9/1973 | Maleski . | |
| 4,006,901 | 2/1977 | Simo . | |
| 4,036,499 | 7/1977 | Sherwin . | |
| 4,093,230 | 6/1978 | Simo . | |
| 4,175,749 | 11/1979 | Simo . | |
| 4,210,330 | 7/1980 | Kosbab . | |
| 4,349,202 | 9/1982 | Scott | 473/584 |
| 4,381,866 | 5/1983 | Simo . | |
| 4,452,460 | 6/1984 | Adams | 473/584 |
| 4,529,208 | 7/1985 | Simo . | |
| 4,558,868 | 12/1985 | Musacchia . | |
| 4,676,512 | 6/1987 | Simo . | |
| 5,145,187 | 9/1992 | Lewis . | |
| 5,160,148 | 11/1992 | Musacchia, Sr. . | |
| 5,482,294 | 1/1996 | Sullivan et al. . | |

*Primary Examiner*—John A. Ricci

*Attorney, Agent, or Firm*—Polster, Lieder, Woodruff & Lucchesi LLC

[57] ABSTRACT

An arrowhead with a removable blade captured within a doubly terminated slot is disclosed. When a number of blades are used, the interlocking blade bodies have complementary recesses whereby each interlocking blade is received into the other interlocking blades. The arrowhead may be integral with and a portion of an arrow, or it may be a separate, detachable ferrule. The tip of the arrowhead is either a unique slotted pyramid, or a conventional cone or spear. Securement of a blade within the arrowhead is achieved through an attachment to the arrowhead. This attachment may perform other functions in the arrowhead, for instance the attachment may also function as the tip of the arrowhead.

24 Claims, 4 Drawing Sheets

ARROWHEAD

CROSS-REFERENCE TO RELATED APPLICATIONS

Not Applicable

STATEMENT REGARDING FEDERALLY SPONSORED RESEARCH OR DEVELOPMENT

Not Applicable.

BACKGROUND OF THE INVENTION

Arrowheads with sharp edges to be used in the hunting of game have been designed for thousands of years. The earliest arrowheads consisted of a sharp stone blade inserted into a slot in the end of a stick arrow. Modern design has changed little as blades are still inserted into slots. Materials and manufacturing technology have been implemented to provide superior strength, sharpness and aerodynamics while increasing the number of blades to take advantage of the increased kinetic energy provided by modern speed bows.

Numerous arrowheads with two separate blades inserted together at right angles by means of interlocking slots have been designed over the years such as U.S. Pat. No. 2,909,372, issued Oct. 20, 1959 to Neri; U.S. Pat. No. 3,741,542, issued Jun. 26, 1973 to Karlsand; U.S. Pat. No. 4,029,319, issued Jun. 14, 1977 to Christen; U.S. Pat. No. 3,614,103, issued Oct. 19, 1971 to Correll and U.S. Pat. No. 4,558,868, issued Dec. 17, 1985 to Musacchia discloses broadheads which open an end of the ferrule with right angle slots and clamp interlocked blades with a screw on closure member. While such a design provides strength due to the clamping of blades it also has the inherent flaw in that the opened end of the body deforms when the closure member is applied which makes true and consistent alignment of the arrowhead with the arrow difficult. This deviation in alignment at today's arrow speeds causes planing which is detrimental to accuracy.

The first arrowhead tips were flat narrow "V" spear tips. Due to the sharp narrow point spear tips are still the best in terms of tissue penetration. Chisel tips were invented decades ago and have been appreciated in recent years (i.e. U.S. Pat. No. 4,210,330, issued Jul. 1, 1980 to Kosbab) for their durability and bone splitting ability due to their wedge shape. Thus, using either tip is a tradeoff.

BRIEF SUMMARY OF THE INVENTION

The present invention provides novel solutions which optimize all of the necessary parameters of broadhead design. Only three parts are necessary for ease of manufacture and assembly: a ferrule with an integral tip and two separate blades or members. Four slots are cut at right angles through the sides of the ferrule and open up a mutual space in the ferrule interior, ends of slots terminating short of the ends of the ferrule to form a ferrule cage. Each blade is separately entered through neighboring slots and positioned in the ferrule, blades then being interlocked inside the ferrule cage by means of one blade positioned inside a recess in the other blade. The arrow, insert or other attachment means immobilizes the blade assembly. The tip of the ferrule is machined to have a uniquely shaped hollow ground "V" spear front which sweeps into a rear chisel shape, yielding premium penetration in both tissue and bone.

Figure 14:
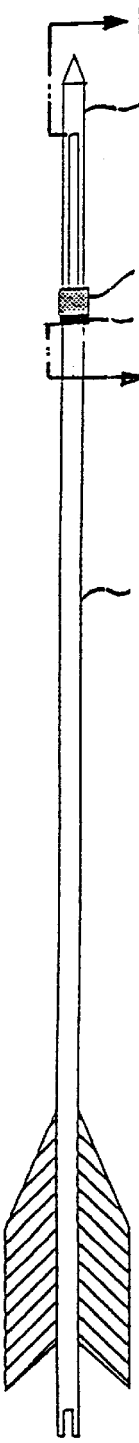
FIG. 14 is a view in side elevation of an embodiment of the present invention wherein the blades are inserted directly into the body of the arrow.
Figure 14A:
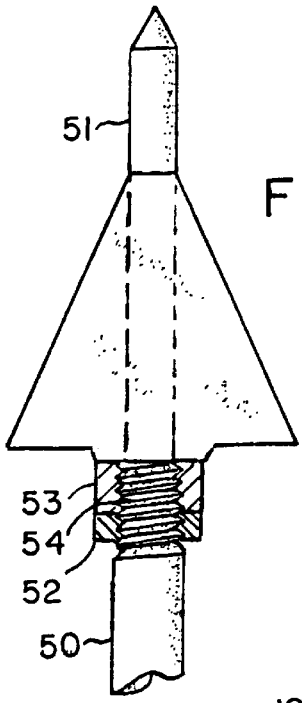
FIG. 14A is a view in side elevation of a portion of the arrow of FIG. 14, taken along line 14A—14A.
Figure 14D:
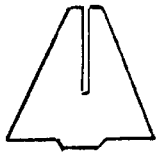
FIG. 14B is a perspective view of a collar for use with the arrow of FIG. 14.
Figure 14E:
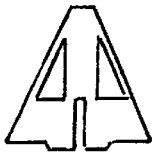
Figure 14F:
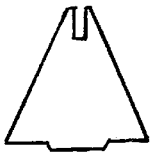
Figure 14G:
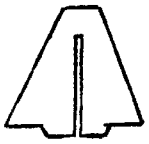
Figure 22:
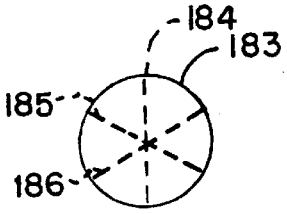
Figure 23A:
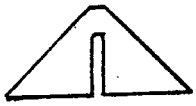
Figure 14B:
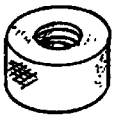
Figure 14C:
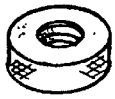
Figure 24A:
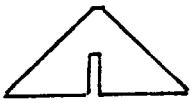
Figure 23B:
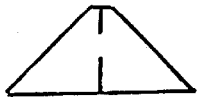
Figure 24B:
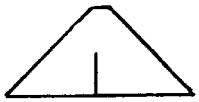
Figure 23C:
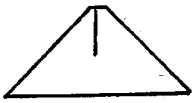
Figure 24C:
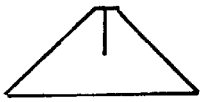
Figure 25:
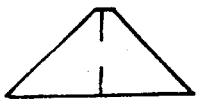
Figure 15:
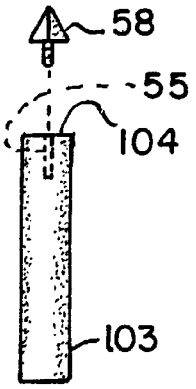
Figure 16:
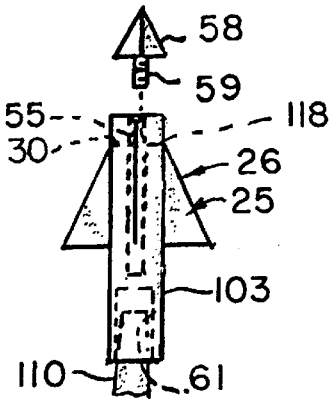
Figure 18:
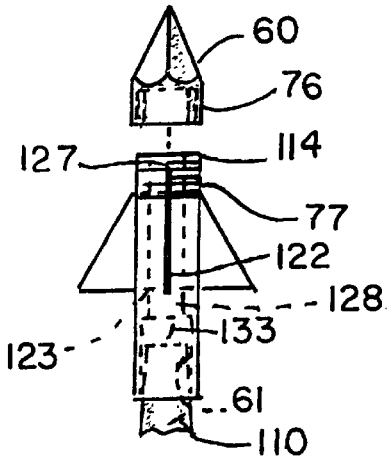
Figure 17:
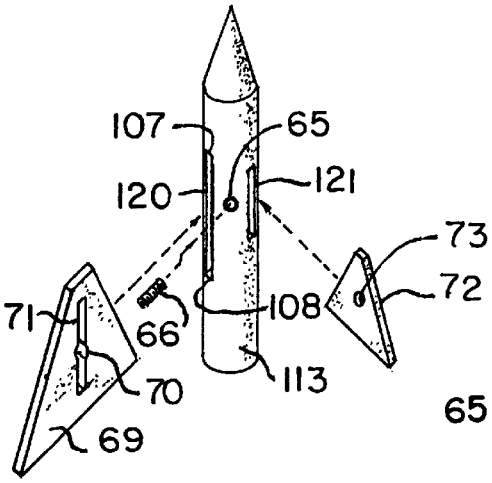
Figure 19:
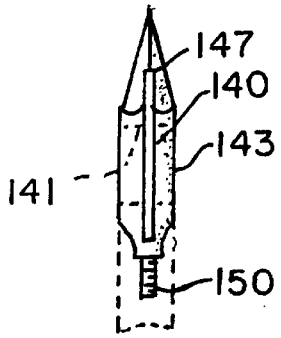
Figure 17A:
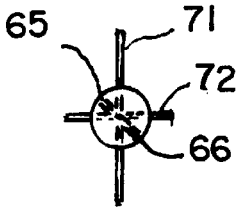
Figure 20:
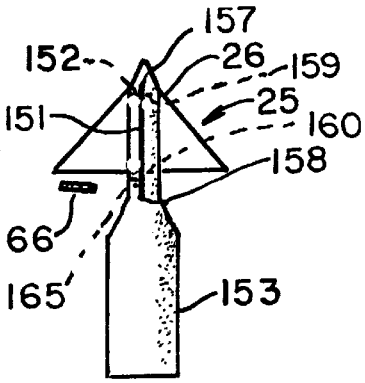
Figure 21:
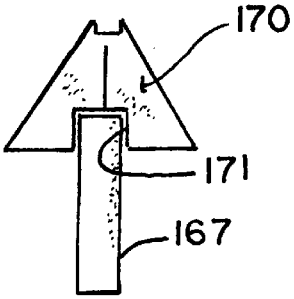
Figure 26A:
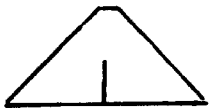
Figure 26C:
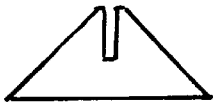
Figure 26B:
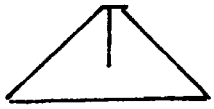
Figure 27A:
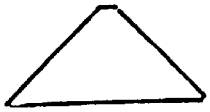
Figure 27B:
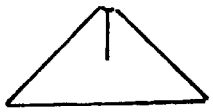
Figure 27C:
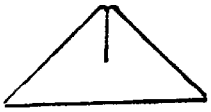
Figure 28A:
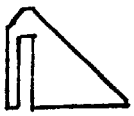
Figure 28B:
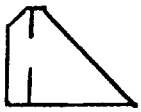
Figure 28C:
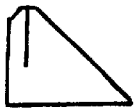

Fiqure 14C is a perspective view of a lock nut for use with the arrow of FIG. 14;

FIGS. 14D–14G show in side elevation blades for use with the arrow of FIG. 14;

FIG. 15 is a view in side elevation of a ferrule of a third embodiment of the present invention;

FIG. 16 is a view in side elevation of a partially assembled broadhead of a fourth embodiment of the present invention;

FIG. 17 is an exploded view of a broadhead of a fifth embodiment of the present invention;

FIG. 17A is a top plan view of a broadhead of a fifth embodiment of the present invention;

FIG. 18 is a view in side elevation of a partially assembled broadhead of a sixth embodiment of the present invention;

FIG. 19 is a view in side elevation of a ferrule of a seventh embodiment of the present invention;

FIG. 20 is a view in side elevation of a partially assembled broadhead of an eighth embodiment of the present invention;

FIG. 21 is a view in side elevation of ninth embodiment of the present invention;

FIG. 22 is a top plan sectional view of a ferrule of a tenth embodiment of the present invention;

FIGS. 23A–23C show views in side elevation of three blades of an eleventh embodiment of the present invention;

FIGS. 24A–24C show views in side elevation of three alternative blades of a twelfth embodiment of the present invention;

FIG. 25 is a view in side elevation of an alternative blade of a thirteenth embodiment of the present invention;

FIGS. 26A–26C show views in side elevation of three alternative blades of a fourteenth embodiment of the present invention;

FIGS. 27A–27C show views in side elevation of three alternative blades of a fifteenth embodiment of the present invention; and FIGS. 28A–28C show views in side elevation of three blades of a sixteenth embodiment of the present invention.

DETAILED DESCRIPTION OF THE INVENTION

Referring to the drawing for one illustrative embodiment of this invention, reference numeral 1 indicates an arrowhead made up of a ferrule 3, a first blade 25 and a second blade 26. The head 1 is mounted to an arrow shaft, not here shown, by means of a fitting 45, which also serves to clamp the blades in place.

The ferrule 3 has a tip 4 at its outer end, a body 5, which, in this embodiment is cylindrical, and a threaded shank 10, projecting along an axial center line of the cylindrical body from a closed or terminal end 8 of the body.

Figure 2:
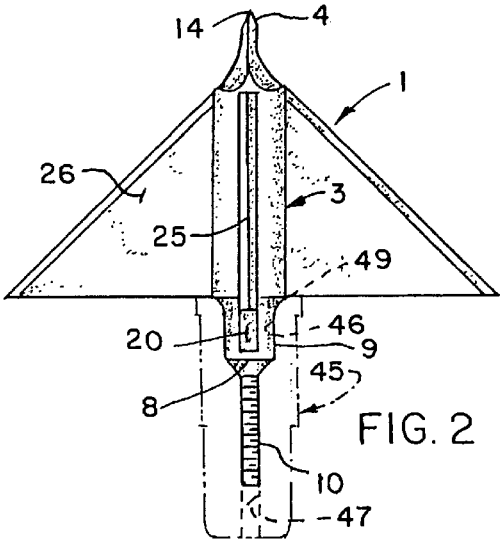
FIG. 2 is a view in side elevation of the broadhead of FIG. 1.
Figure 10:
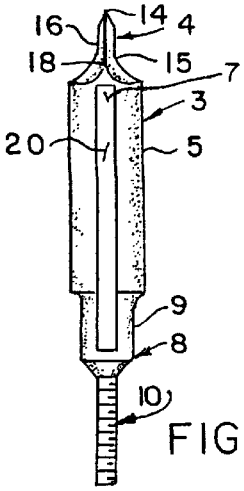
FIG. 10 is a view in side elevation of a ferrule of the broadhead shown in FIGS. 1 and 2.
Figure 11:
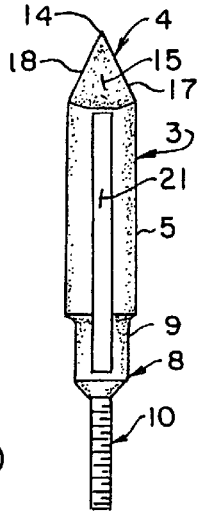
FIG. 11 is a view in side elevation of the ferrule, at 90° from the view shown in FIG. 10.
Figure 12:
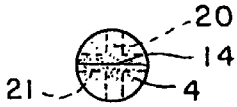
FIG. 12 is a top plan view of the ferrule.

In this, preferred embodiment, the tip 4 has a sharp, spear point 14, from which two concave sides 15 and 16 extend, flaring downwardly outwardly to the cylindrical body 5, as shown particularly in FIGS. 2 and 10. The sides 15 and 16 meet along sharp edges 17 and 18.

First and second slots 20 and 21 extend transversely through the body 5, at right angles to one another. The slots 20 and 21 are closed ended, stopping short of the tip at their upper ends 7 and of the closed end 8 at their lower ends.

Figure 3:
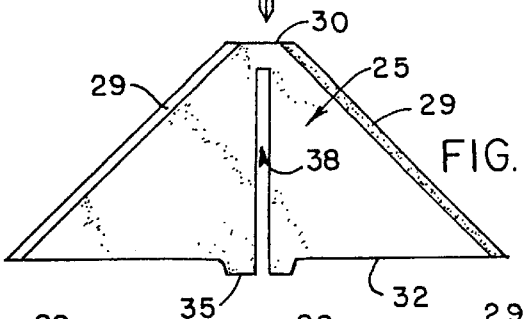
FIG. 3 is a view in side elevation of a first blade of the broadhead shown in FIGS. 1 and 2.
Figure 4:
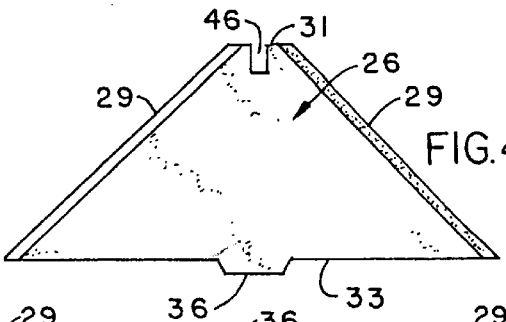
FIG. 4 is a view in side elevation of a second blade.
Figure 5:
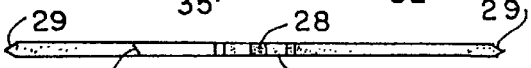
FIG. 5 is a bottom plan view of the blade shown in FIG. 3.
Figure 6:
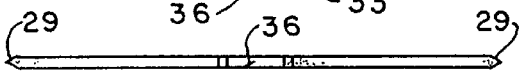
FIG. 6 is a bottom plan view of the blade shown in FIG. 4.
Figure 7:
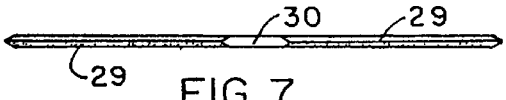
FIG. 7 is a top plan view of the blade shown in FIG. 3.
Figure 8:
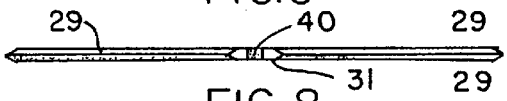
FIG. 8 is a top plan view of the blade shown in FIG. 4.
Figure 9:
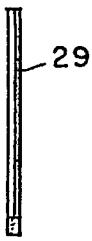
FIG. 9 is a view in side elevation of either of the blades shown in FIGS. 3 and 4.

Both of the blades 25 and 26 are trapezoidal in elevation, as shown particularly in FIGS. 3 and 4, with sharp outer edges 29. The first blade 25 has a narrow top edge 30 and a wide bottom edge 32, between which the sharp edges 29 extend. The second blade 26 has a narrow top edge 31 and a wide bottom edge 33. The wide bottom edge 32 of the first blade has a central apron 35, through which a slot or recess 38 extends. The slot or recess 38 ends short of the top edge 30. The top edge 31 of the second blade has a slot or recess 40 extending through it, and extending a short distance toward an apron 36.

In this embodiment, the arrow shaft fitting 45 has a cup 46 at its upper end, shaped complementarily to a reduced, necked stem section 9 between the body 5 and the closed end 8 of the ferrule. The fitting 45 has a threaded passage axially aligned with the threaded shank 10 and internally threaded to receive the shank 10. The cup 46 is of a depth to permit an upper rim 49 of the fitting 45 to engage the lower edges 32 and 33 of the blades, thus locking them in place.

The fitting 45 is in most respects conventional. It can have a skirt to embrace a graphite arrow shaft, or a reduced section to be inserted in the open end of a hollow aluminum shaft, or be secured to a shaft in any conventional way. Generally, it is fixed to the shaft, and aligned carefully with the long axis of the shaft. The ferrule, with the blades assembled, is then screwed into the fitting.

In assembling the broadhead, the first blade 25 is inserted in the slot 20, and pushed against the upper end 7 of the slot. The slot 20 is sufficiently long to permit the blade 26 to be slipped through the slot 21, through the blade slot or recess 38, which is aligned with the slot 21, to the place in which the notch or recess 40 is aligned with the blade 25. The blade 26 is then moved upwardly to embrace the blade 25 between the upper end of the slot or recess 38 and the upper edge 30 of the blade 25. The fitting 45 and the assembled broadhead are then screwed together, until the upper edge 49 engages snugly the lower edges 32 and 33 of the blades.

As has been indicated, the provision of the closed end 8 ensures that there will be no distortion of the ferrule when it is screwed into the fitting 45.

Figure 1:
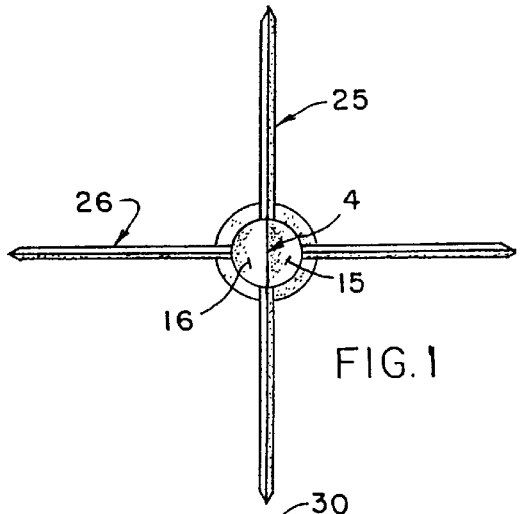
FIG. 1 is a top plan view of a broadhead of this invention.
Figure 13:
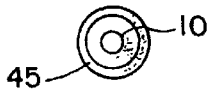
FIG. 13 is a bottom plan view of the ferrule.

In another embodiment of the present invention referring to FIG. 14, an arrow 50 includes a slot 51 formed directly in the arrow's shaft near the tip portion of the arrow. At least one blade 25 is positioned inside the slot 51, and an externally threaded attachment part 54 integral with the shaft of the arrow is provided near the rear or terminal end of the slot. An internally threaded sleeve or collar 53 and a lock nut 52 mounted on the arrow shaft's integral attachment part securely locks the blade or blades in place. When a plurality of slots are formed within the shaft of the arrow, corresponding blades include slots or recesses which cooperate to interlock when positioned inside the slots of the shaft of the arrow as described in connection with FIGS. 1 and 13, for example. Attachment means can be of the kind described in connection with the embodiment with a single slot.

In a third embodiment of the present invention, referring to FIG. 15, the terminal end or tip 104 of a ferrule 103 or arrow 50 may be adapted to receive a separate modular point 58.

In a fourth embodiment of the present invention, referring to FIG. 16, the modular point 58 includes a threaded stud 59 at its base. The internally threaded blind hole 55 in ferrule 103 communicates with the uppermost portion of slot 118. When the modular point 58 is applied to the tip of ferrule 103, the threaded stud 59 traverses the internally threaded blind hole 55 and engages the top edge 30 of blade 25, securing blades 25 and 26 in alignment. An internal bore 61 is provided at the terminal end of ferrule 103 whose diameter is proportioned to be slightly larger than the diameter of a conventional arrow shaft, so that the broadhead is secured by the fastening of the terminal end of ferrule 103 over a mating receiving end 110 of the shaft of an arrow.

In a fifth embodiment of the present invention, referring to FIGS. 17 and 17A, a ferrule 113 has an internally threaded hole 65 whose axis is transverse to the longitudinal axis of the ferrule 113, between an upper closed end 107 and a lower closed end 108 of a slot 120 and at an angle to slots 120 and 121. Transverse hole 65 forms an opening from one side of ferrule 113 to the other side. Blade 69 is a modification of blade 25 as shown in FIG. 3, the modification being hole 70 located generally in the center of blade 69 and blade slot 71, that corresponds with the transverse internally threaded hole 65 of the ferrule 3 when blade 69 is inserted into slot 20. A second blade 72 has corresponding hole 73 located generally in the center of blade 72. Blade 69 is inserted into slot 120 of ferrule 113 so that blade hole 70 is aligned with transverse hole 65 in ferrule 113. Second blade 72 is inserted into slot 121 of ferrule 113 and through blade slot 71 of first blade 69 such that second blade hole 73 is aligned with transverse hole 65 of ferrule 113, and blade hole 71 of first blade 69. A set screw 66 is inserted through transverse internally threaded hole 65, threaded hole 70 of blade 69 and threaded hole 73 of blade 72, thus securing blades 69 and 72 in ferrule 113.

In a sixth embodiment of the present invention, referring to FIG. 18, a ferrule 133 includes an externally threaded portion 77 at tip 114, coextensive with an upper closed end 127 of a slot 122. Modular point 60 includes an internally threaded neck 76 at its base. Blades 25 and 26 are inserted into slots 122 and 123 of ferrule 133 and interengage. The modular point 60 is screwed onto external threads 77, engaging top edge 30 of blade 25 and securing blades 25 and 26. In this embodiment the ferrule is shown as having an internal bore 61 which is received by the mating receiving end 110 of an arrow as described in connection with the fourth embodiment.

In a seventh embodiment of the present invention, referring to FIG. 19, slot 140 terminates in an upper closed end 147 within the integral point 147 of ferrule 143. Blades 25 and 26 are inserted into slots 140 and 141 and interengage. Threaded shank 150 of ferrule 143 is secured to arrow shaft fitting 45 in the manner described in FIG. 2, and blades 25 and 26 are held in alignment in slots 140 and 141 in the manner described in FIG. 2, with the narrow top edges 30 and 31 of blades 25 and 26 respectively meeting within the area of the integral point 147 of ferrule 143.

In an eighth embodiment of the present invention, referring to FIG. 20, ferrule 153 includes slot 151 with and upper closed end 157 and lower closed end 158. Ferrule 153 also includes slot 152 with and upper closed end 159 and lower closed end 160. Ferrule 153 has an internally threaded hole 165 whose axis is transverse to the longitudinal axis of the ferrule 113, at a point between upper closed end 157 and the lower closed end 158 of slot 151, but closer to the lower closed end 158 of slot 151. Transverse hole 165 forms an opening from one side of ferrule 153 to the other side. Blades 25 and 26 are inserted into slots 151 and 152, and interengage, while central apron 35 of blade 25 and central apron 36 of blade 26 obstruct the internal opening of transverse hole 165. Blades 25 and 26 are urged upward, until firm contact is made with upper closed ends 157 and 160, moving central aprons 35 and 36 above transverse hole 165 and clearing the opening. Securement means include a set screw 66 applied to transverse hole 165, securing blades 25 and 26 in alignment.

In a ninth embodiment of the present invention, referring to FIG. 21, blade 170 has a recess 171 generally in the center of its lower edge. As blade 170 is urged toward the arrow shaft 167, the recess 171 of blade 170 is centered about arrow shaft 167, allowing blade 170 to partially cover arrow shaft 167.

In a tenth embodiment of the present invention, referring to FIG. 22, a ferrule 183 has three slots, 184, 185 and 186 formed at an angle with respect to one another.

FIGS. 23, 24, 25, 26 and 27 show various configurations of blade slots for use in the three-slotted ferrule 183 of FIG. 22.

FIG. 28 shows a modified three blade arrangement, with blades forming a 60° angle and blade slots formed near the edge of the adjacent side of the blade body.

Numerous variations in the construction of the broadhead of this invention will occur to those skilled in the art in the light of the foregoing disclosure. The external shapes of the blades and the angles of the sharp edges can be varied. The sets of slots may be offset from one another longitudinally. The blades may be offset at an angle relative to the ferrule. Although the modified spear and chisel tip is the preferred embodiment, other forms of tip can be used, and the modified chisel tip can be employed with other ferrules. The body of the ferrule can be made polygonal, rather than smoothly cylindrical. The terminal portion 8 may also include numerous fittings besides the threaded shank 10, as can the fitting 45. The blades may have top ends that are blunt, recessed or pointed. The ferrule slots need not be symmetrical in longitudinal orientation, nor are the ferrule slots necessarily the same longitudinal length. The blades are similarly not necessarily the same size with respect to one another. The ferrule slots may be formed at an angle other than 90° with respect to each other, for instance 120°. These are merely illustrative.

I claim:

1. A broadhead comprising a one piece elongated ferrule, closed at upper and lower ends, with a plurality of closed ended slots through a central axis of said ferrule, one piece blades mounted in said slots, and means for holding said blades in position in said ferrule.

2. The broadhead of claim 1 further including a tip, wherein the tip comprises a pyramidal apex with hollow ground notches.

3. A broadhead comprising an elongated ferrule with a center axis, said ferrule having a tip and a monolithic body with two slots transversely through it and through said center axis, said slots being at substantially right angles to one another and ending short of both ends of said body, and two blades extending removably through said slots at right angles to one another, a first one of said blades having a slot opening through the center of a lower edge and terminating short of an upper edge of said blade and a second one of said blades having a notch opening through the center of an upper edge and terminating short of a lower edge of said blade, said blade slot and said blade notch being centrally aligned with said ferrule center axis, said ferrule slots being of a length to permit the second blade to pass through the slot in the first blade to clear the first blade and to permit the second blade then to be shifted toward the said tip to move the notch of the second blade around a part of said first blade between an upper end of said first blade notch and the upper edge of said first blade.

4. A broadhead comprising an elongated ferrule having a body and tip, said tip comprising a pyramidal apex with transverse notches formed in two opposing edges short of said apex.

5. A broadhead comprising:

a one piece ferrule with a tip portion and a terminal portion, said terminal portion including an attachment, said attachment being adapted to mate with an end of a shaft, at least one slot formed within said one piece ferrule, said slot being formed completely within said one piece ferrule between said tip portion and said terminal portion, said slot further being formed through the body of the ferrule;

at least one blade sized to fit within said slot; and securement means, said securement means being proportioned to immobilize said blade when applied to said ferrule.

6. The broadhead of claim 5 wherein the apex of said tip portion of said one piece ferrule is pointed.

7. The broadhead of claim 5 wherein the one piece ferrule includes a plurality of slots, said slots being formed at an angle to one another and meeting at the center of said one piece ferrule, and a plurality of blades sized to fit within said slots, said blades formed with cooperable recesses to interlock with one another inside said one piece ferrule.

8. The broadhead of claim 7 wherein the number of slots is two, said slots intersecting at right angles to one another at the center of said one piece ferrule.

9. The broadhead of claim 8 wherein the number of said blades is two.

10. The broadhead of claim 7 wherein the number of said slots in said ferrule is three.

11. The broadhead of claim 10 wherein the number of said blades is three.

12. The broadhead of claim 11 wherein the number of blade surfaces extending from said ferrule is six.

13. The broadhead of claim 11 wherein the number of blade surfaces extending from said ferrule is three.

14. The broadhead of claim 7 wherein said blades are of different shapes.

15. The broadhead of claim 7 wherein said slots in said ferrule are of the same size.

16. The broadhead of claim 5 wherein said attachment is releasable.

17. The broadhead of claim 16 wherein said attachment is threaded.

18. An arrowhead comprising:

a ferrule with multiple slots terminating short of both ends of said ferrule, at least one closed ended ferrule slot extending through a central axis of the ferrule concealed by a mating receiving end of an arrow; and at least one blade positioned inside a slot in said ferrule.

19. The arrowhead of claim 18 wherein a recess in the base of at least one blade allows the mating receiving end of the arrow to be positioned between the cutting edges of said blade.

20. The arrowhead of claim 18 wherein at least one blade has a recess in the front edge of said blade.

21. The arrowhead of claim 18 wherein the tip of said ferrule includes multiple reduced sides, at least one ferrule slot extending through the reduced sides of said tip.

22. An arrowhead comprising a one piece elongate ferrule, closed at upper and lower ends, with at least one slot through a central axis of said ferrule, said at least one slot being closed at upper and lower ends, and a fastener securing said ferrule to an arrow shaft.

23. The arrowhead of claim 22 wherein at least one blade is positioned within said at least one slot of said ferrule.

24. The arrowhead of claim 23 wherein said fastener secures said at least one blade to said ferrule.

* * * * *